United States Patent [19]

Anderson et al.

[11] Patent Number: 5,060,734

[45] Date of Patent: Oct. 29, 1991

[54] SEAWATER HYDRAULIC ROCK DRILL

[75] Inventors: Scot Anderson, Ventura; Bruce W. Farber, Oakview; John P. Kunsemiller, Oxnard, all of Calif.

[73] Assignee: United States of America, Washington, D.C.

[21] Appl. No.: 405,827

[22] Filed: Sep. 11, 1989

[51] Int. Cl.[5] ..... B25D 9/18

[52] U.S. Cl. ..... 173/128; 173/134; 91/170 R

[58] Field of Search ..... 173/104, 105, 131, 132, 173/134, 135, DIG. 4, 128; 91/170 R, 300

[56] References Cited

U.S. PATENT DOCUMENTS

| | | | |
|---|---|---|---|
| 3,232,176 | 2/1966 | Henning et al. | 173/105 |
| 3,945,442 | 3/1976 | Amtsberg . | |
| 4,006,783 | 2/1977 | Granholm | 173/105 |
| 4,157,121 | 6/1979 | Amtsberg et al. . | |
| 4,376,620 | 3/1983 | Colston . | |
| 4,444,274 | 4/1984 | Suwabe | 173/134 |
| 4,593,768 | 6/1986 | Eklöf | 173/131 |
| 4,648,609 | 3/1987 | Deike | 173/131 |
| 4,676,323 | 6/1987 | Henriksson . | |

*Primary Examiner*—Frank T. Yost
*Assistant Examiner*—Scott A. Smith

[57] ABSTRACT

A seawater hydraulic rock drill having a trigger which when engaged by a diver allows pressurized seawater to be directed through an open supply poppet valve assembly into a drive chamber having a plunger. The pressurized seawater drives the plunger into a piston, an anvil, and a drill bit creating a percussive impact into a rock surface breaking up the rock surface. At the same time pressurized seawater exits the drive chamber through an orifice into a reversible seawater hydraulic motor which rotates the drill bit thereby pulverizing the broken rock. As the plunger approaches the end of a drive cycle, the supply poppet is pressurized closing the supply poppet valve assembly and cutting off the flow of seawater to the drive chamber. Pressurized seawater then drives the piston and plunger to their initial positions, the supply poppet valve assembly opens, and the cycle is repeated.

22 Claims, 6 Drawing Sheets

SEAWATER HYDRAULIC ROCK DRILL

BACKGROUND OF THE INVENTION

1. Field of the Invention

This invention relates generally to hydraulic tools. In particular, this invention relates to a rock drill in which seawater is used as the hydraulic fluid.

2. Description of the Prior Art

Prior art hydraulic rock drills designed for underwater usage have typically employed oil as the hydraulic fluid. The hydraulic fluid is pumped from a surface ship through a supply hose down to the diver, and must be returned to the surface ship via a return hose. The need for such supply and return hoses limits the diver's handling of the rock drill, particularly where heavy surge and strong currents exist. The use of oil as the hydraulic fluid creates logistics problems in requiring shipping and storage of large quantities of oil. Leakage of the oil fluid from the rock drill contaminates the environment, and leakage of seawater into the rock drill readily damages the precision rock drill components.

There are a variety of prior art rock drills which use oil as the working pressurized fluid. For example, U.S. Pat. No. 4,157,121 discloses a rock drill having a piston hammer which is arranged to impact on an anvil in the form of a chisel which extends out of a housing and which uses oil as the working fluid. U.S. Pat. Nos. 4,676,323 and 3,945,442 illustrate other examples of prior art rock drills which use oil as the working fluid.

The design of a hydraulic rock drill which utilizes seawater as the hydraulic fluid presents a serious challenge to the designer because of the general corrosiveness of seawater on precision made parts used in such rock drills. The poor lubricity of seawater and a much lower viscosity for seawater than for conventional oil hydraulic fluid contribute to the problem. The generally lower viscosity which seawater exhibits means that all design clearances should be an order of magnitude less than for prior art oil hydraulic fluid rock drills.

With these and other disadvantages known to oil hydraulic fluid rock drills, the present invention was conceived and one of its objectives is to provide a rock drill which utilizes seawater as the operating fluid and provides satisfactory results for the user.

It is another object of the present invention to provide a rock drill designed such that seawater acts as the lubricant for wear surfaces.

It is still another object of the present invention to provide a rock drill which utilizes seawater as the hydraulic fluid so as not to contaminate the environment.

Various other advantages and objectives of the present invention will become apparent to those skilled in the art as a more detailed description of the invention is set forth below.

SUMMARY OF THE INVENTION

The aforesaid and other objects of the invention are accomplished by a rock drill which utilizes seawater as the pressurized working fluid. Pressurized seawater enters the rock drill through a normally closed valve which is opened by a trigger. The pressurized seawater is then directed through an open supply poppet assembly into a drive chamber having a plunger. The pressurized seawater drives the plunger into a piston, an anvil, and a drill bit creating a percussive impact into a rock surface which breaks up the rock surface. At the same time pressurized seawater exits the drive chamber through an orifice into a reversible seawater hydraulic motor which rotates the drill bit thereby pulverizing the broken rock, and allowing the broken rock to be flushed away. As the plunger approaches the end of a drive cycle, the supply poppet is pressurized by seawater closing the supply poppet, and cutting off the flow of seawater to the drive chamber. Pressurized seawater then drives the piston and plunger to their initial positions, the supply poppet valve assembly opens and the cycle is repeated.

DETAILED DESCRIPTION OF THE PREFERRED EMBODIMENT

Figure 1:
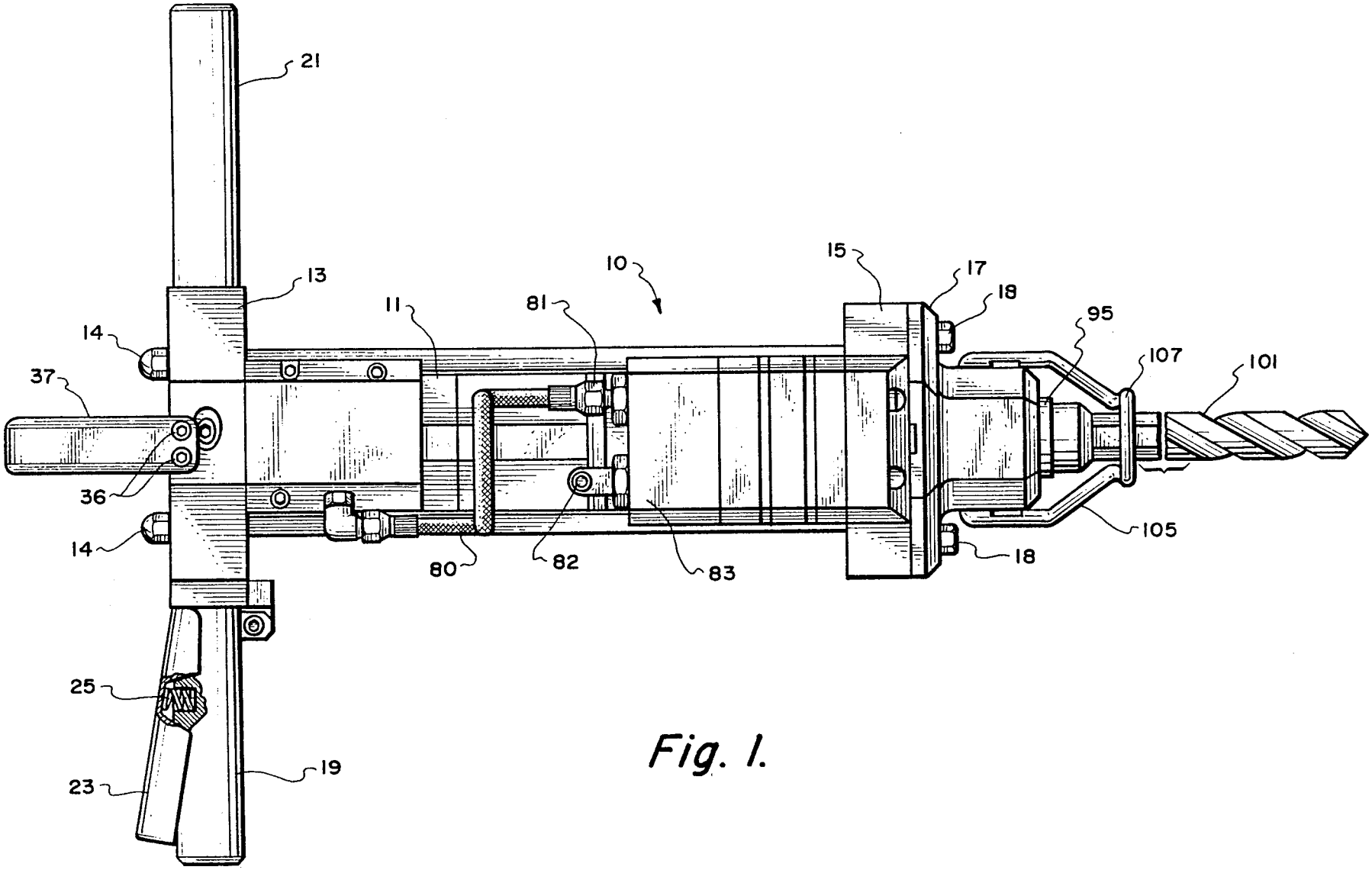
FIG. 1 is a side view of a seawater hydraulic rock drill constituting the present invention.
Figure 4:
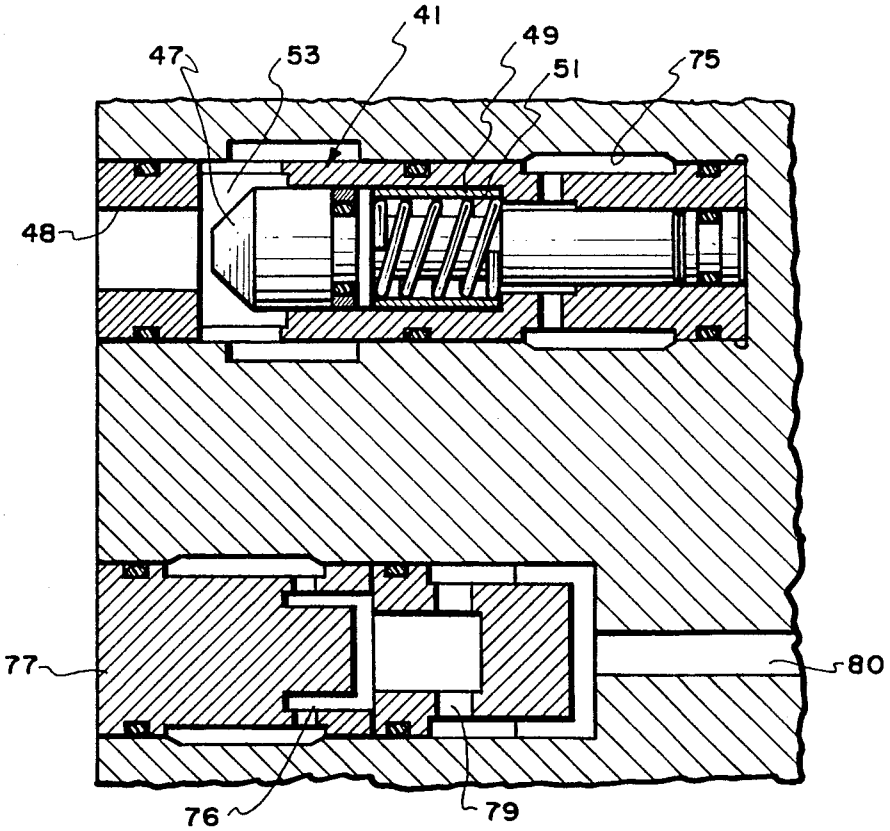
FIG. 4 is a sectional view taken along line 4—4 of FIG. 2 illustrating the supply poppet assembly of the present invention.
Figure 2:
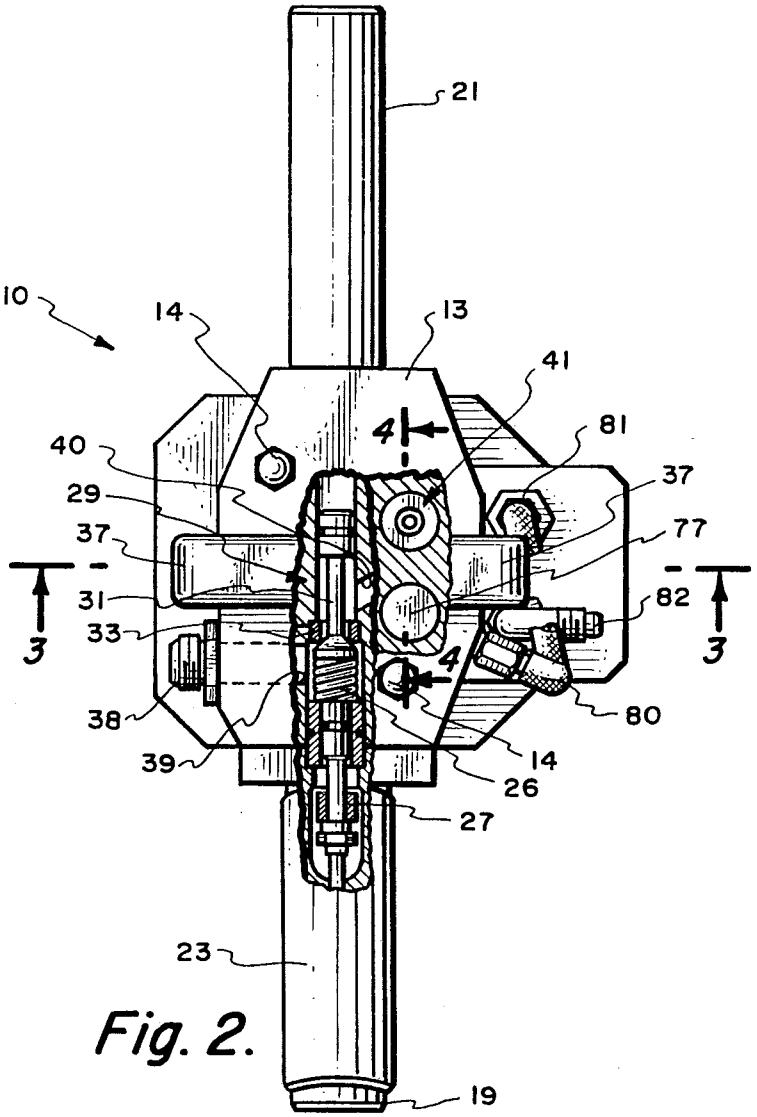
FIG. 2 is a rear elevational view of the seawater hydraulic rock drill constituting the present invention.

Referring first to FIGS. 1 thru 5 there is shown a seawater hydraulic rock drill 10 embodying the principles of the present invention. Rock drill 10 comprises a linear drive assembly housing 11, a back flange/plate 13 secured to housing 11 by a plurality of bolts 14 so as to enclose the rear end of housing 11, and a front head 15 which is secured to the front end of housing 11 by a front flange 17 so as to enclose the front end of housing 11. Front flange 17 is, in turn, attached to housing 11 by a plurality of bolts 18.

Attached to back flange 13 by threaded connections, not shown, are a pair of handles 19 and 21, which may be used by a diver, not shown, to hold rock drill 10 when rock drill 10 is operational. Handle 19 has a trigger 23 which is held in a nonactivated position by springs 25 and 26. Trigger 23 is connected by coupling member 27 to an inlet valve 29 consisting of a valve plunger 31 which is held against a valve seat 33 by spring 26. Attached to back plate 13 by a plurality of bolts 36 is a U shaped handle 37 which may be used by a diver to hold rock drill 10 when rock drill 10 is not operational.

There is located within back flange 13 an inlet port 38 through which pressurized seawater flows when rock drill 10 is operational. A passageway 39 connects inlet port 38 to inlet valve 29 while a passageway 40 connects inlet valve 29 to a supply poppet valve assembly 41 located near the rear of housing 11, FIG. 4.

Supply poppet valve assembly 41 consists of a poppet sleeve 45, a supply poppet 47 slidingly fitted within sleeve 45, a supply poppet seat 48 located at the front of assembly 41 and a spring sleeve 49 mounted within poppet sleeve 45. Spring sleeve 49 has mounted therein a spring 51 which is in engagement with the head of supply poppet 47.

A passageway 53 having one end located at the front of supply poppet valve assembly 41 connects supply poppet valve assembly 41 to the rear end of a drive chamber 55 located in a plunger housing 56 at the rear of linear drive assembly housing 11. Drive chamber 55 has mounted therein a rear plunger sleeve 57 and a front plunger sleeve 59, with sleeve 57 having an inner surface diameter that is greater than the inner surface diameter of sleeve 59.

Slidingly mounted within drive chamber 55 is a drive plunger 61 which has a head 63 and a stem 65. Plunger head 63, which has a diameter that is greater than the inner surface diameter of sleeve 59, is slidingly fitted within sleeve 57 and abuts a hard impact insert 67, located at the rear end of sleeve 59, when a force is exerted upon plunger 61 by pressurized seawater flowing through passageway 53 into drive chamber 55.

Plunger stem 65 is slidingly fitted within front plunger sleeve 59 and has a channel 69, with the width of channel 69 being greater than the distance between a pair of channels 71 and 73 located on the inner surface of sleeve 59. Channel 71 is connected by a passageway 74 to passageway 40, FIG. 5 while a passageway 75 having one end thereof located below spring sleeve 49 connects assembly 41 to channel 73.

A passageway 76 connects the rear end of drive chamber 55 to the first port of an exhaust orifice 77, while the second port of exhaust orifice 77 is connected by a passageway 79 to drive chamber 55 near the front end of rear plunger sleeve 57. The third port of exhaust orifice 77 is connected by a flexible passageway 80 to one of a pair of inlet ports 81 and 82 of a reversible vane type hydraulic motor 83 which is secured to front head 15.

Motor 83 may be a vane motor of the type described in U.S. Pat. No. 4,376,620 which utilizes pressurized seawater as the operating fluid. Motor 83 has a shaft 84, two inlet ports 81 and 82 and two exhaust ports 85 and 87, FIG. 5. By connecting passageway 80 to inlet port 81 motor 83 rotates in one direction, while connecting passageway 80 to inlet port 82 will cause motor 83 to rotate in the opposite direction.

A drive gear 89, supported by a bearing 91, is drivingly affixed to shaft 84 of motor 83. The teeth, not shown, of drive gear 89 mesh with the teeth, not shown, of a driven gear 93. The inner circumference of driven gear 93 engages a chuck 95 positioned at the front end of housing 11 and which is held in place within driven gear 93 by a plurality of gear pins 99.

The upper portion of a drill bit 101 is slidingly fitted within chuck 95 while a retaining member 105 secures drill bit 101 to rock drill 10. Retaining member 105 has a semicircular shaped lower portion 107 and is rotationally affixed to front flange 17 so that different size drill bits may be interchanged with rock drill 10. As is best illustrated in FIG. 3, an adapter 109, which fits within chuck 95 is retained by retaining ring 103 and, is utilized for smaller size drill bits, while larger size drill bits fit directly into chuck 95.

Figure 3:
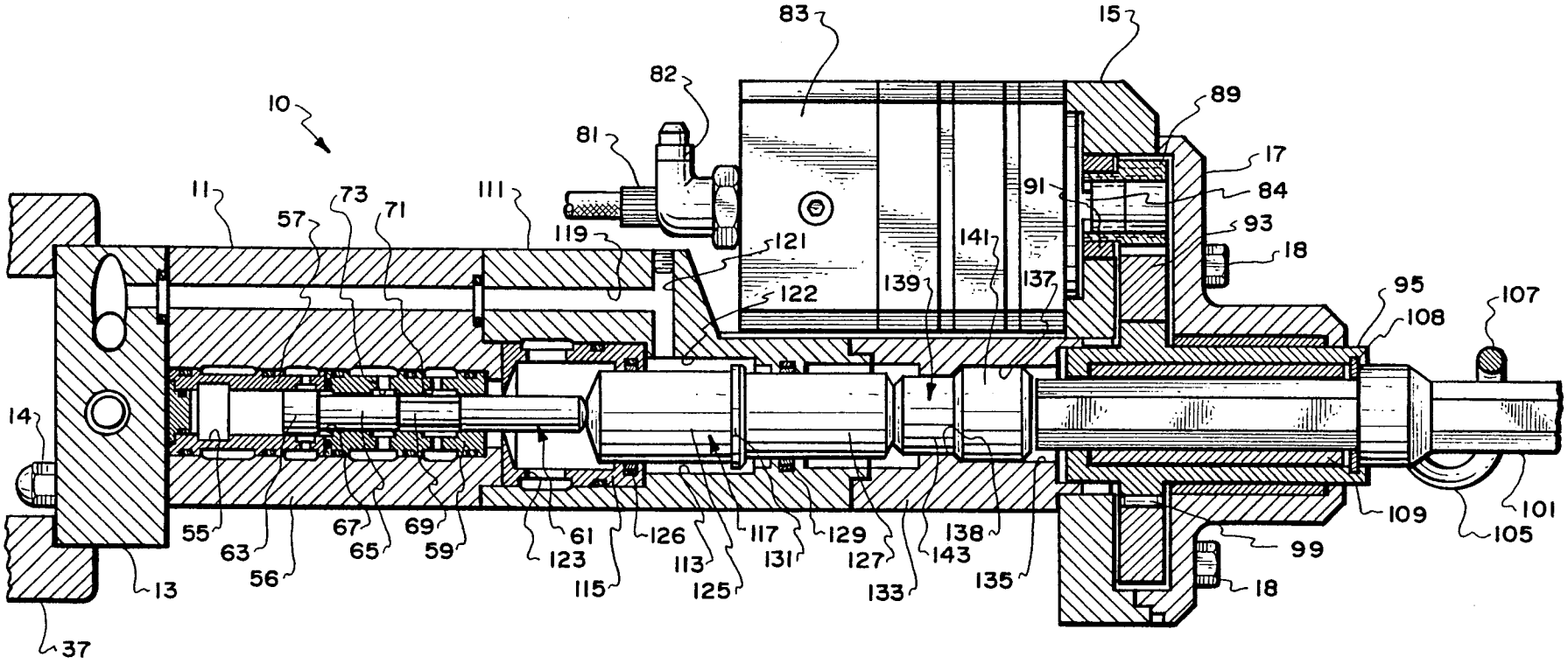
FIG. 3 is a sectional view taken along line 3—3 of FIG. 2 of the rock drill constituting the present invention.
Figure 5:
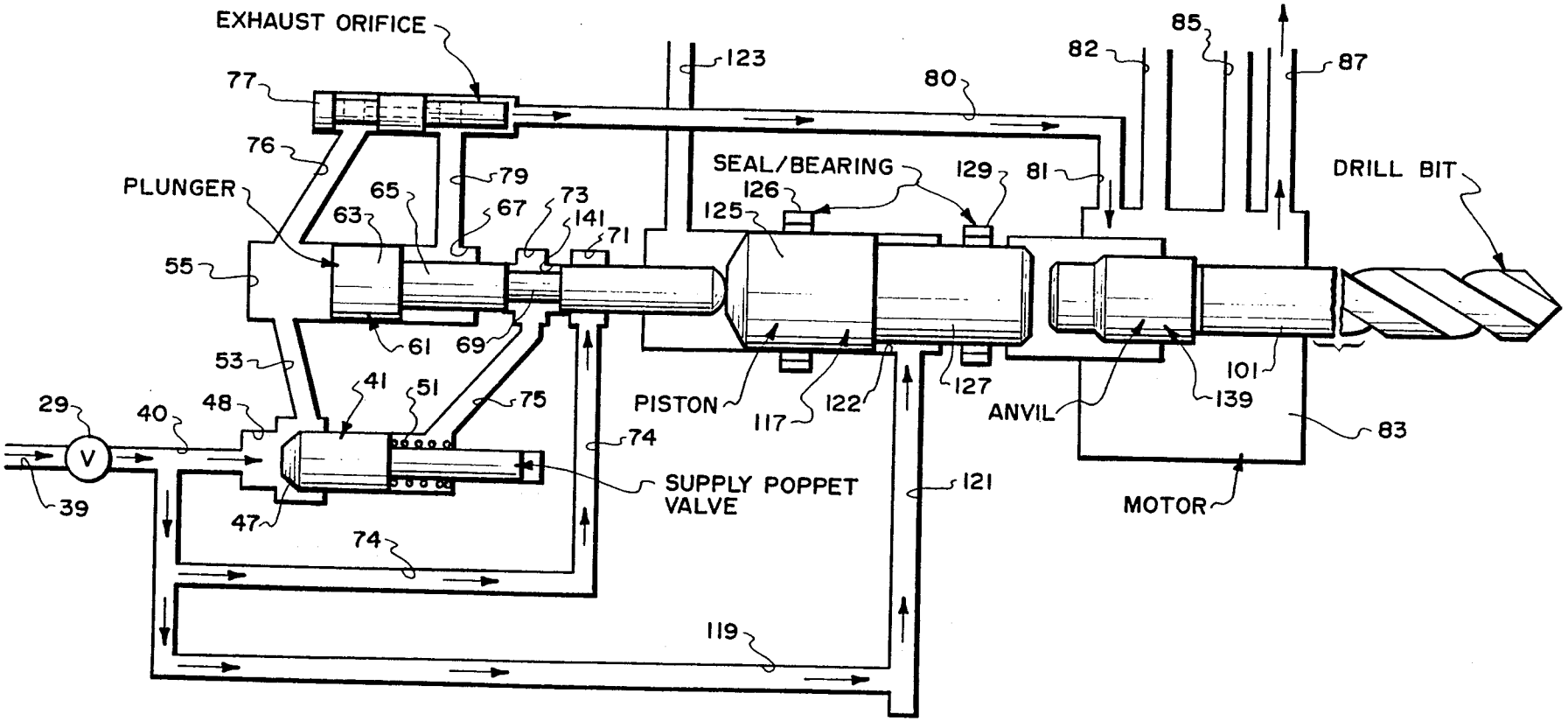
FIG. 5 is a schematic diagram illustrating the hydraulic circuit of the present invention.

Referring now to FIGS. 3 and 5 there is positioned at the front end of plunger housing 56, a piston housing 111 which has a cavity 113.

Mounted within cavity 113 is a piston sleeve 115 which has a piston 117 slidingly fitted therein. A passageway 119 connects passageway 40 to an inlet port 121 located in an enlarged region 122 near the front end of cavity 113, while there is located near the rear end of cavity 113 an exhaust port 123.

Piston 117 has a major diameter portion 125 which is slidingly fitted within piston sleeve 115 and supported by a bearing/seal 126, and a minor diameter portion which is slidingly fitted within the front portion of cavity 113 and supported by seal/bearing 129. Pressurized seawater flowing through inlet port 121 into enlarged region 122 and acting upon the difference in area between diameter portions 125 and 127 provides a return force on piston 117. A flange 131 located between portion 125 and portion 127 abuts the front end of enlarged region 113 during a power stroke. The rear of piston 117 abuts the rear of sleeve 115 during a return stroke.

Positioned at the front end of piston housing 111 is an anvil housing 133 which has a cavity 135. Cavity 135 has on enlarged region 137 at the front end which tapers to a narrower region 138 at the rear end. Slidingly fitted within cavity 135 is an anvil 139 which has a major diameter 141 tapering to a minor diameter 143 so that during a return stroke anvil 139 will abut the taper of cavity 135. Anvil 139 is in axial alignment with chuck 95 so that during a power stroke anvil 139 strikes chuck 95.

In the exemplary seawater hydraulic rock drill of FIGS. 1 thru 4, materials successfully utilized in critical components are as follows:

| Component | Component Name | Material |
|---|---|---|
| 47 | Supply Poppet | Nitronic 50 |
| 45 | Supply Poppet Sleeve | Nitronic 60 |
| 48 | Supply Poppet Seat | Nitronic 60 |
| 61 | Drive Plunger | 440C Steel with Nedox Coating |
| 57 | Rear Plunger Sleeve | Nitronic 60 |
| 59 | Front Plunger Sleeve | Nitronic 60 |
| 67 | Insert | MP35N Stainless Steel |
| 117 | Piston | MP35N Stainless Steel with TiN PVD Coating |
| 139 | Anvil | MP35N/TiN PVD |

The operation of the present invention will now be discussed in conjunction with all of the figures of the drawing.

Figure 6A:
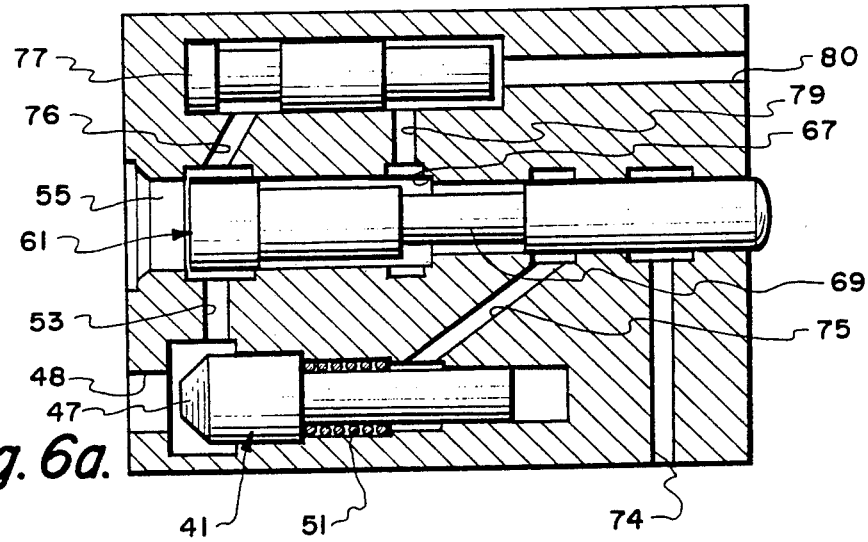
FIG. 6*a* to 6*f* illustrates the operation of the plunger, piston, and supply poppet assembly of the present invention during the drive and return cycles.

Referring first to FIGS. 1, 3, 5 and 6*a* and is best illustrated in FIG. 6*a* and FIG. 5 plunger 61 and piston 117 are positioned at the commencement of a power stroke drive cycle which will result in an impact blow by plunger 61 and piston 117 on anvil 139 which will, in turn, impact drill bit 101.

When a diver, not shown, engages trigger 23, inlet valve 29 opens allowing high pressurized seawater (pressurized between 1350 psi and 1450 psi) pumped by a source, not shown, to enter rock drill 10 through inlet port 38, flow through passageways 39 and 40, supply poppet 47, which is shown in an open position, and passageway 53 into drive chamber 55. High pressurized seawater acting upon the end of the head of plunger 61 causes plunger 61 and piston 117 to move toward anvil 139.

At the same time pressurized seawater is exiting drive chamber 55, flowing through passageway 76, exhaust orifice 77 and flexible passageway 80 into motor 83 so as to activate motor 83, which rotates drill bit 101 thereby pulverizing a rock surface broken by the impact of anvil 139 upon drill bit 101.

Figure 6B:
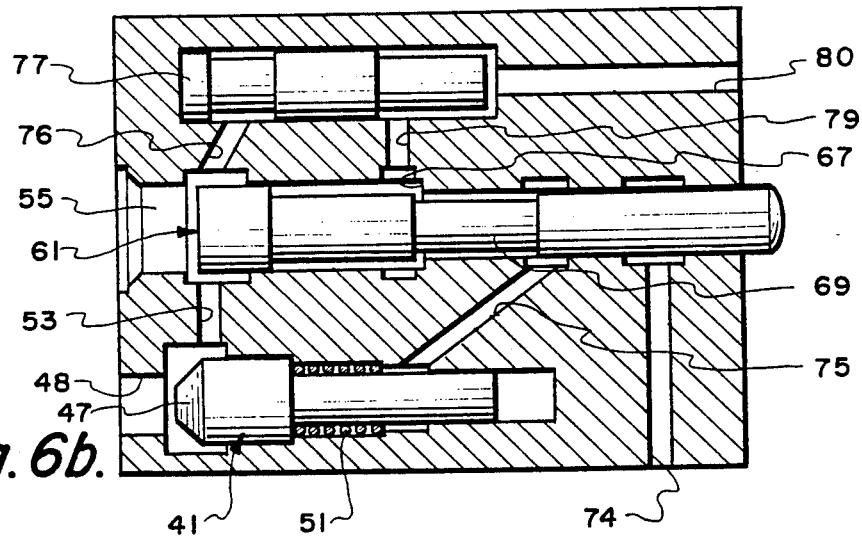
Figure 6C:
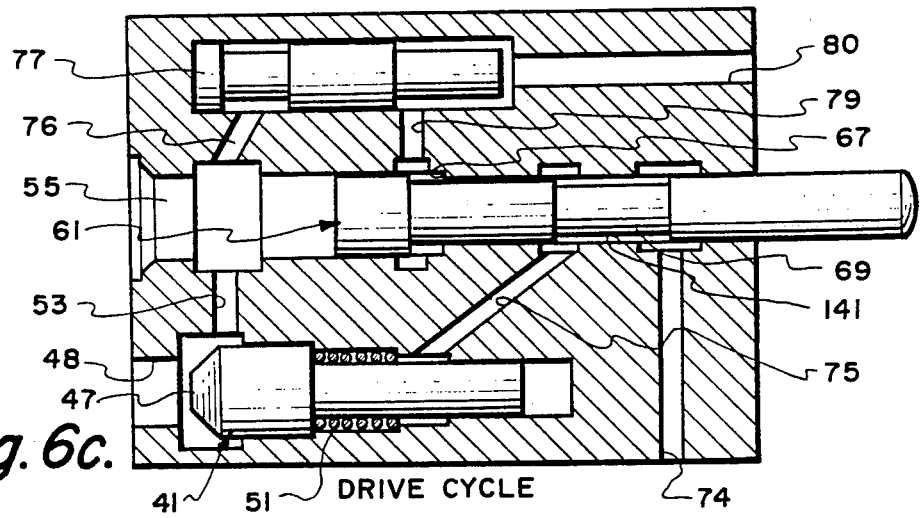

As is best illustrated in FIGS. 6*b* and 6*c* plunger 61 accelerates causing piston 117 to accelerate and impact anvil 139, thereby driving anvil 139 into drill bit 101 creating a percussive impact into the rock surface breaking up the rock surface. As shown in FIG. 6*c* when plunger 61 approaches the end of the drive cycle, channel 69 is positioned so as to provide a fluid flow path 141 between passageway 74 and passageway 75.

Figure 6D:
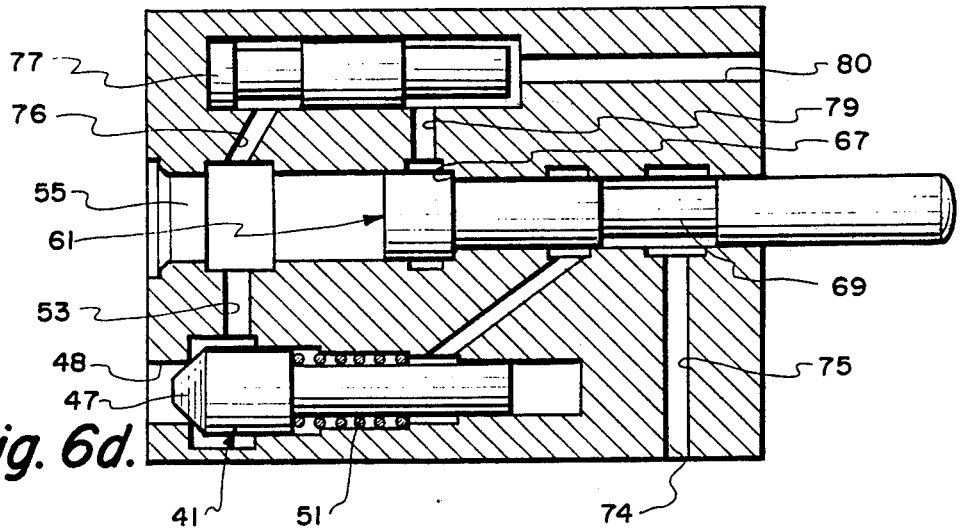

Pressurized seawater flows from passageway 74, through channel 69 and passageway 75 into the rear portion of poppet assembly 41 thereby pressure balancing supply poppet 47 which allows spring 51 to exert a force and impart movement upon supply poppet 47 so that the head of supply poppet 47 will engage seat 48 cutting off the flow of pressurized seawater to drive chamber 55. When drive chamber 55 is cut-off from the flow of pressurized seawater, as is best illustrated in FIG. 6*d*, plunger 61 abuts and stops on the hard impact insert 67.

Figure 6E:
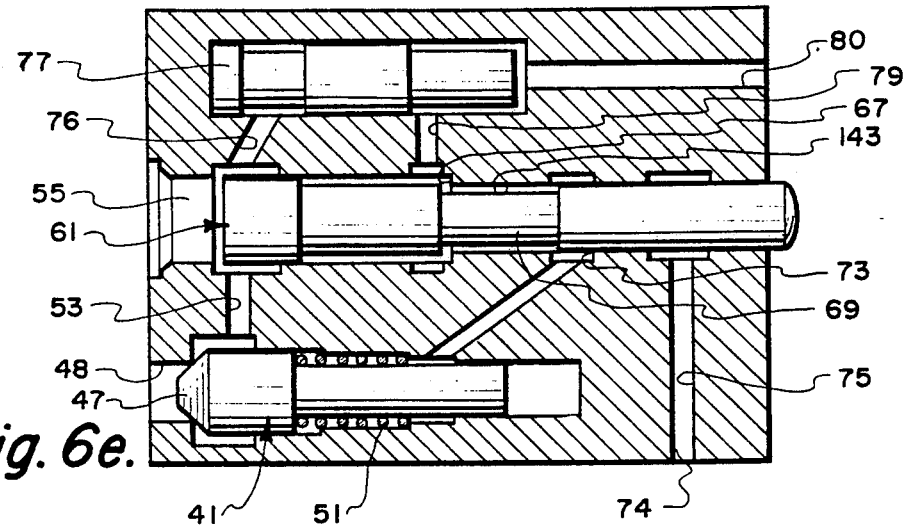

As is best illustrated in FIG. 5 and 6*e* pressurized seawater flowing from passageway 119 through inlet port 121 into enlarged region 122 and acting upon the difference in area between diameter portions 125 and 127 provides a return force on piston 117. The return movement by piston 117 imparts movement on plunger 61 until plunger 61 reaches the relative position shown in FIG. 6*e*, which allows channel 69 to provide a fluid flow path 143 between passageway 75 and passageway 79. Seawater then flows from the rear portion of supply poppet valve assembly 41 through passageway 75, channel 73 and passageway 79 relieving pressure from the back side of the head of supply poppet 47, thereby allowing poppet 47 to disengage from poppet seat 48.

Figure 6F:
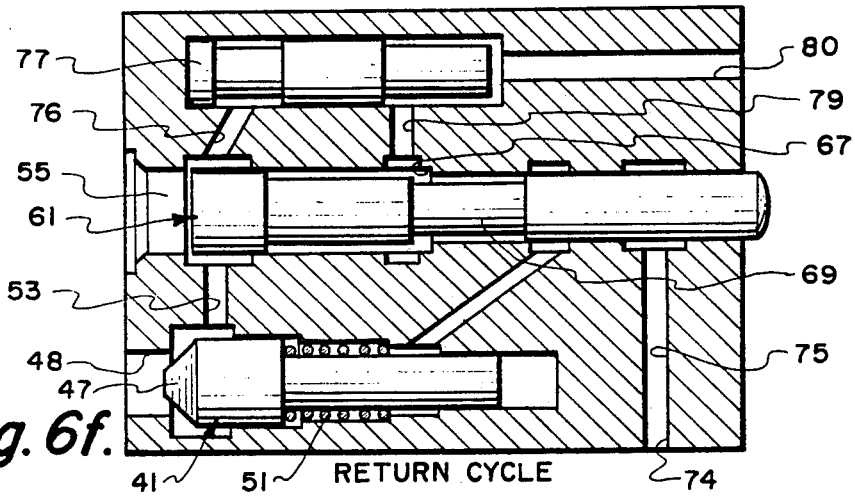

As is best illustrated in FIG. 6*f* plunger 61 returns to the initial position of the drive cycle, and the opening of supply poppet valve assembly 41 allows pressurized seawater to flow into drive chamber 55 beginning a new drive cycle. The drive/return cycle of rock drill 10 is repeated at the rate of approximately 3000 cycles per minute.

From the foregoing, it may readily be seen that the present invention comprises a new, unique and exceedingly useful seawater hydraulic rock drill which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A rock drill utilizing pressurized seawater as the operating fluid comprising:

a housing having a drive chamber located at a rear end thereof, a first cavity located at forward end thereof, and a second cavity located between said drive chamber and said first cavity;

a drive plunger slidingly fitted for axial movement within said drive chamber, said drive plunger having a head and a stem;

an anvil slidingly fitted for axial movement within said first cavity;

a piston slidingly fitted for axial movement within said second cavity, said piston having a major diameter portion and a minor diameter portion with the major diameter portion being positioned adjacent the stem of said drive plunger and the minor diameter portion being positioned adjacent said anvil;

valve means connected to a supply line and arranged in said housing to provide pressurized seawater to said drive chamber, the pressurized seawater acting upon the head of said drive plunger thereby causing said drive plunger and said piston to accelerate and impact said anvil, said valve means to cutoff the flow of pressurized seawater to said drive chamber after said piston impacts said anvil and allow the seawater within said drive chamber to exit therefrom;

said valve means comprising a supply poppet valve assembly located within said housing, said supply poppet valve assembly including a poppet sleeve, a supply poppet having a head and sliding fitted within said poppet sleeve, a supply poppet seat connected to a supply line, said supply poppet seat being located at a front end of said supply poppet valve assembly, and a spring mounted within a rearward portion of said poppet sleeve, said spring being in engagement with the head of said supply poppet;

first, second and third passageways, said first passageway connecting the front end of said supply poppet valve assembly to the rear end of said drive chamber, said second passageway connecting a first channel located in a forward portion of said drive chamber to the rearward portion of said supply poppet valve assembly, and said third passageway connecting a second channel located in the forward portion of said drive chamber to said supply line;

an exhaust orifice having first, and second ports; fourth, and fifth passageways, said fourth passageway connecting the rear end of said drive chamber to the first port of said orifice, and a said fifth passageway connecting the front end of the major diameter portion of said drive chamber to the second port of said orifice; and a channel located within the stem of said plunger, said channel within the stem of said plunger having a width greater than the distance between the first and second channels of said drive chamber;

means positioned at the front end of said housing in axial alignment with said anvil for engaging a drill bit to be used by said rock drill;

motor means affixed to a front head secured to the front end of said housing and having a shaft operatively connecting said motor means with said engaging means, said motor means being adapted for rotation of said engaging means in either rotation direction; and passageway means connecting said supply line to a forward portion of said second cavity, said passageway means being adapted to supply pressurized seawater to said second cavity so that the pressurized seawater acts upon the difference in diameter between the major and minor diameter portions of said piston thereby imparting a return motion of said piston and said plunger after said piston impacts said anvil.

2. The rock drill of claim 1 wherein said drive plunger is fabricated from 440C steel with a Nedox coating.

3. The rock drill of claim 1 wherein said piston and said anvil are each fabricated from MP35N stainless steel with a TiN PVD coating.

4. The rock drill of claim 1 wherein said supply poppet is fabricated from Nitronic 50.

5. The rock drill of claim 1 wherein said supply poppet sleeve and said supply poppet seat are each fabricated from Nitronic 60.

6. The rock drill of claim 1 further characterized by a rear plunger sleeve positioned in the rearward portion of said drive chamber, a front plunger sleeve positioned in the forward portion of said drive chamber, and an insert positioned at the rear end of said front plunger sleeve.

7. The rock drill of claim 6 wherein said rear and front plunger sleeves are fabricated from Nitronic 60.

8. The rock drill of claim 6 wherein said insert is fabricated from MP35N stainless steel.

9. The rock drill of claim 1 further characterized by a handle affixed to the rear end of said housing said handle having a trigger connected by a coupling member to an inlet valve, said inlet valve being connected to said supply line.

10. The rock drill of claim 1 further characterized by a U shaped handle affixed to the rear end of said housing.

11. The rock drill of claim 1 further characterized by a retaining member rotationally affixed to the front end of said rock drill and having a semicircular shaped lower portion, said retaining member being adapted to secure said drill bit to said rock drill.

12. A hydraulic rock drill which uses seawater as the operating fluid, comprising:

a housing having a drive chamber located at a rear end thereof, a first cavity located at a forward end thereof, and a second cavity located between said drive chamber and said first cavity;

said drive chamber having a major diameter portion at a rear end thereof and a minor diameter portion at a front end thereof, said minor diameter portion having a pair of channels located therein;

said second cavity having an inlet port located in a forward portion thereof;

a supply poppet valve assembly located within said housing, said supply poppet valve assembly including a poppet sleeve, a supply poppet having a head and slidingly fitted within said poppet sleeve, a supply poppet seat connected to a supply line, said supply poppet seat being located at a front end of said supply poppet valve assembly, and a spring mounted within a rearward portion of said poppet sleeve, said spring being in engagement with the head of said supply poppet;

first, second and third passageways, said first passageway connecting the front end of said supply poppet valve assembly to the rear end of said drive chamber, said second passageway connecting the first channel of said drive chamber to the rearward portion of said supply poppet valve assembly, and said third passageway connecting the second channel of said drive chamber to said supply line;

an exhaust orifice having first, second and third ports;

a drive plunger slidingly mounted for axial movement within said drive chamber, said drive plunger having a head and a stem;

an anvil slidingly fitted for axial movement within said first cavity;

a piston slidingly fitted for axial movement within said second cavity, said piston having a major diameter portion and a minor diameter portion with the major diameter portion being positioned adjacent the stem of said drive plunger and the minor diameter portion being positioned adjacent said anvil;

a reversible seawater hydraulic motor affixed to a front head secured to the front end of said housing, said seawater hydrayulic motor having a pair of inlet ports and a shaft;

fourth, fifth, sixth and seventh passageway, said fourth passageway connecting the rear end of said drive chamber to the first port of said orifice, said fifth passageway connecting the front end of the major diameter portion of said drive chamber to the second port of said orifice, said sixth passageway connecting one of the pair of inlet ports of said motor to the third port of said exhaust orifice, and the seventh passageway connecting said supply line to the inlet port of said second cavity;

a chuck positioned at the front end of said housing in axial alignment with said anvil, said chuck being in rotational engagement with the shaft of said seawater hydraulic motor and being adapted to engage a drill bit; and the stem of said plunger having a channel with the width of said channel being greater than the distance between the first and second channels of said driver chamber.

13. The rock drill of claim 12 wherein said supply poppet is fabricated from Nitronic 50.

14. The rock drill of claim 12 wherein said supply poppet sleeve and said supply poppet seat are each fabricated from Nitronic 60.

15. The rock drill of claim 12 wherein said drive plunger is fabricated from 440C steel with a Nedox coating.

16. The rock drill of claim 12 further characterized by a rear plunger sleeve positioned in the rearward portion of said drive chamber, a front plunger sleeve positioned in the forward portion of said drive chamber, and an insert positioned at the rear end of said front plunger sleeve.

17. The rock drill of claim 16 wherein said rear and front plunger sleeves are fabricated from Nitronic 60.

18. The rock drill of claim 16 wherein said insert is fabricated from MP35N stainless steel.

19. The rock drill of claim 12 wherein said piston and said anvil are each fabricated from MP35N stainless steel with a TiN PVD coating.

20. The rock drill of claim 12 further characterized by a handle affixed to the rear end of said housing said handle having a trigger connected by a coupling member to an inlet valve, said inlet valve being connected to said supply line.

21. The rock drill of claim 12 further characterized by a U shaped handle affixed to the rear end of said housing.

22. The rock drill of claim 12 further characterized by a retaining member rotationally affixed to the front end of said rock drill and having a semicircular shaped lower portion, said retaining member being adapted to secure said drill bit to said rock drill.

* * * * *